US009417571B2

(12) United States Patent
Fukami

(10) Patent No.: US 9,417,571 B2
(45) Date of Patent: Aug. 16, 2016

(54) IMAGE FORMING APPARATUS INCLUDING A FIXING TEMPERATURE SETTING SECTION

(71) Applicant: KYOCERA Document Solutions Inc., Osaka (JP)

(72) Inventor: Mariko Fukami, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/805,671

(22) Filed: Jul. 22, 2015

(65) Prior Publication Data

US 2016/0026128 A1 Jan. 28, 2016

(30) Foreign Application Priority Data

Jul. 25, 2014 (JP) ..... 2014-152370

(51) Int. Cl.
*G03G 15/20* (2006.01)
*G03G 15/00* (2006.01)

(52) U.S. Cl.
CPC ..... *G03G 15/2039* (2013.01); *G03G 15/5062* (2013.01); *G03G 15/55* (2013.01); *G03G 15/6573* (2013.01); *G03G 2215/00569* (2013.01)

(58) Field of Classification Search
None
See application file for complete search history.

(56) References Cited

U.S. PATENT DOCUMENTS 6,232,027 B1 * 5/2001 Matsunaga ..... G03G 9/08755 430/108.3
2005/0260003 A1 * 11/2005 Tezuka ..... G03G 15/5062 399/15

(Continued)

FOREIGN PATENT DOCUMENTS

JP 2007-004051 1/2007
JP 2011-221338 11/2011

OTHER PUBLICATIONS

English machine translation of Horie (JP 2011-221338 A), by Horie, Takayuki; published Nov. 4, 2011; "Image Forming Apparatus".*

*Primary Examiner* — David Gray
*Assistant Examiner* — Geoffrey T Evans
(74) *Attorney, Agent, or Firm* — Wenderoth, Lind & Ponack, L.L.P.

(57) ABSTRACT

An image forming apparatus includes an image forming unit, a fixing unit that fixes the toner image formed on the recording paper, a rubbing roller that rubs a fixing surface of the recording paper with the fixed toner image, and an image density detection unit that detects image density of the fixing surface of the recording paper having passed through the rubbing roller, wherein a plurality of patch images for fixability evaluation are formed on one piece of recording paper at a predetermined interval in a recording paper conveyance direction, fixing temperature of the fixing unit is changed for each of the formed patch images, the patch images are fixed to the recording paper, and comparison of each image density of a rubbed part and a non-rubbed part by the rubbing roller is performed for each patch image fixed at each fixing temperature, so that appropriate fixing temperature is set.

5 Claims, 7 Drawing Sheets

(56) References Cited

U.S. PATENT DOCUMENTS

2006/0024604 A1* 2/2006 Sugiura ..... G03G 9/0806 430/111.4
2007/0259284 A1* 11/2007 Shibai ..... G03G 9/09321 430/110.2
2009/0035685 A1* 2/2009 Tamura ..... G03G 9/0821 430/109.4
2009/0274476 A1* 11/2009 Nakane ..... G03G 15/2039 399/69
2012/0156604 A1* 6/2012 Fukatsu ..... G03G 13/20 430/105
2014/0099577 A1* 4/2014 Moribe ..... G03G 9/08755 430/108.9
2015/0086230 A1* 3/2015 Fujimori ..... G03G 15/2039 399/69
2015/0362873 A1* 12/2015 Fukami ..... G03G 15/2025 399/333

* cited by examiner

IMAGE FORMING APPARATUS INCLUDING A FIXING TEMPERATURE SETTING SECTION

CROSS-REFERENCE TO RELATED APPLICATION

This application is based upon and claims the benefit of priority from Japanese Patent Application No. 2014-152370 filed on Jul. 25, 2014, the entire contents of which are incorporated herein by reference.

BACKGROUND

The technology of the present disclosure relates to an image forming apparatus, and more particularly, to a technology for optimizing fixing temperature.

In an electrophotographic image forming apparatus, various image formation conditions, such as an applied voltage of an internal mechanism or a charging device, a developing bias voltage, a transfer voltage, and fixing temperature, are set such that an output image is optimized. Similarly, toner for development (hereinafter, simply referred to as "toner") is also set corresponding to respective image forming apparatuses such that an output image is optimized. In recent years, as image forming apparatuses, a wide variety of apparatuses have been developed and sold commercially in response to the use of users such as a full color apparatus, a monochrome apparatus, and an image formation speed. Accordingly, toner has also been diversified.

There has been proposed a technology in which for fixability of a tone image to a recording paper which is one of qualities of an image forming apparatus, at the time of exchange of a toner container, a fixability test image is formed, the fixability test image having passed through a fixing device is rubbed with a rubbing roller, and fixability is evaluated from the difference of image density between a rubbed part and a non-rubbed part, so that fixing temperature of the fixing device is adjusted. Furthermore, there has been proposed a fixability evaluation technology in which the fixability is evaluated using a smear measuring apparatus serving as a detection means of the fixability and fixing conditions such as a nip width and fixing temperature are changed.

SUMMARY

An image forming apparatus according to one aspect of the present disclosure includes a conveying unit configured to convey a recording paper, an image forming unit, a fixing unit, a control section, a rubbing roller, an image density detection unit, a determination section, and a fixing temperature setting section. The image forming unit is configured to form a toner image on the recording paper conveyed by the conveying unit. The fixing unit is configured to fix the toner image, which has been formed on the recording paper by the image forming unit, to the recording paper by thermal compression. The control section is configured to cause the image forming unit to form a plurality of patch images by the on one piece of recording paper at a preset interval in a conveyance direction of the recording paper, to change fixing temperature of the fixing unit for each of the formed patch images for fixing the patch images to the recording paper. The rubbing roller is configured to rub a part of each patch image fixed by the fixing unit. The image density detection unit is configured to detect image density of each patch image on the recording paper having passed through the rubbing roller. The determination section is configured to determine whether a ratio of each image density of a part rubbed by the rubbing roller and image density of a part not rubbed, detected by the image density detection unit in each fixed patch image is within a preset reference value. The fixing temperature setting section is configured to set fixing temperature, which has been used in fixing of the patch image with the ratio of each image density determined to be within the preset reference value by the determination section, as fixing temperature to be used at the time of normal image formation by the image forming unit.

DETAILED DESCRIPTION

Figure 1:
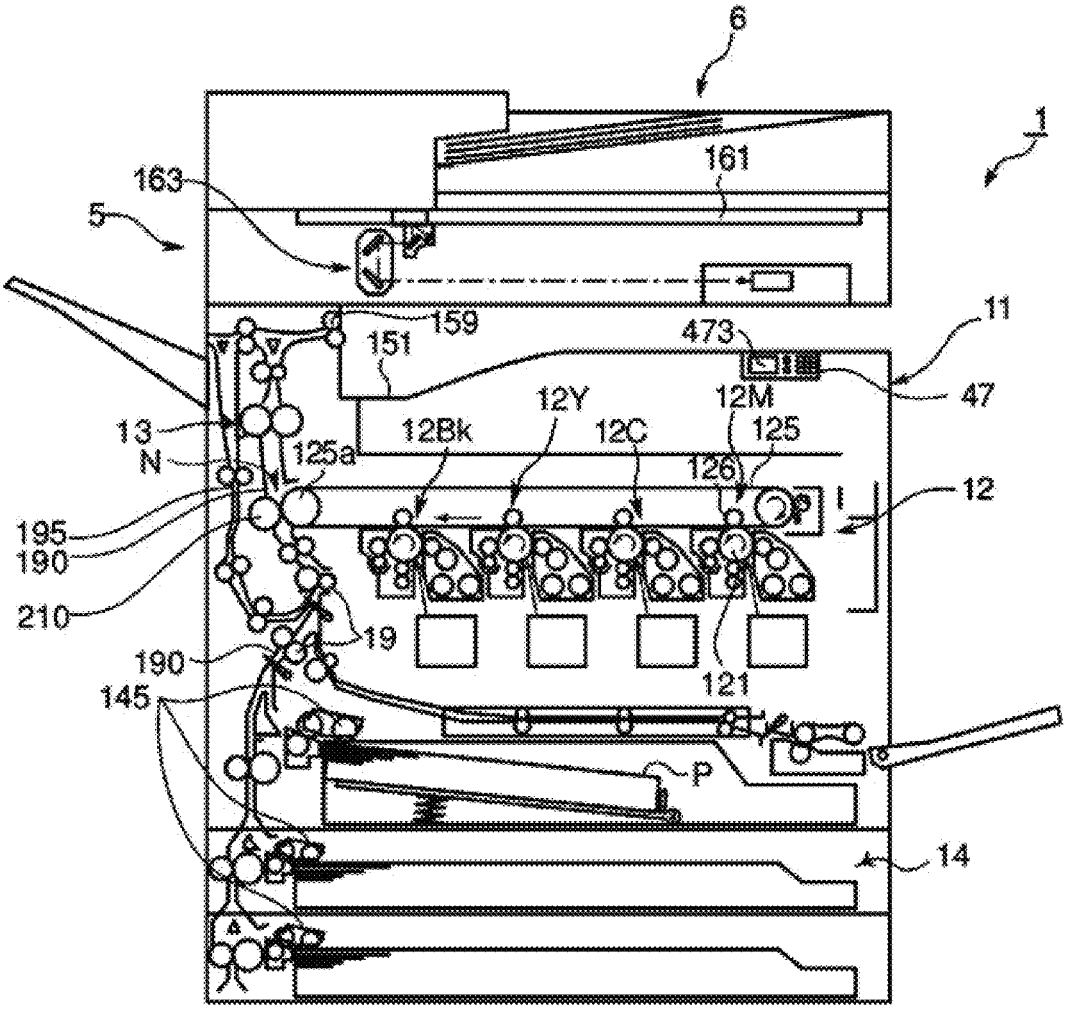
FIG. 1 is a front sectional view illustrating a structure of an image forming apparatus according to an embodiment.

Hereinafter, an image forming apparatus according to the present embodiment will be described with reference to the drawings. FIG. 1 is a front sectional view illustrating a structure of the image forming apparatus according to the present embodiment.

An image forming apparatus 1 according to the present embodiment, for example, is a multifunctional peripheral having a plurality of functions such as a copy function, a printer function, a scanner function, and facsimile function. The image forming apparatus 1 is configured to include an operating unit 47, an image forming unit 12, a fixing unit 13, a paper feeding unit 14, a document feeding unit 6, a document reading unit 5 and the like in an apparatus body 11.

The operating unit 47 receives instructions such as an image formation operation execution instruction and a document reading operation execution instruction for various operations and processes executable by the image forming apparatus 1 from an operator. The operating unit 47 has a display section 473 that displays operating guidance and the like to the operator.

When the image forming apparatus 1 performs a document reading operation, the document reading unit 5 optically reads an image of a document fed by the document feeding unit 6 or a document placed on a document placement glass 161, and generates image data. The image data generated by the document reading unit 5 is preserved in an embedded HDD, a network-connected computer and the like.

When the image forming apparatus 1 performs an image formation operation, the image forming unit 12 forms a toner image on a recording paper P fed from the paper feeding unit as a recording medium on the basis of the image data generated by the aforementioned document reading operation, image data received from the network-connected computer, image data stored in the embedded HDD, and the like. When the image forming apparatus 1 performs color printing, an image forming unit 12M for magenta, an image forming unit 12C for cyan, an image forming unit 12Y for yellow, and an image forming unit 12Bk for black of the image forming unit 12 respectively form toner images on a photosensitive drum 121 through charging, exposure, and development processes on the basis of respective color components constituting the aforementioned image data, and allow the toner images to be transferred onto an intermediate transfer belt 125 by a primary transfer roller 126.

The toner images of the aforementioned each color transferred onto the intermediate transfer belt 125 are superposed on the intermediate transfer belt 125 by adjusting a transfer timing, and thus become a color toner image. A secondary transfer roller 210 allows the color toner image formed on the surface of the intermediate transfer belt 125 to be transferred to the recording paper P conveyed from the paper feeding unit 14 along a conveyance path 190 at a nip portion N between a driving roller 125*a* and the secondary transfer roller 210 with the intermediate transfer belt 125 therebetween. Then, the fixing unit 13 fixes the toner image on the recording paper P to the recording paper P by thermal compression. The recording paper P subjected to the color image formation and the fixing process is discharged to a discharge tray 151.

The paper feeding unit 14 has a plurality of paper feeding cassettes. A control section 100 (FIG. 3) rotationally drives a pick-up roller 145 of a paper feeding cassette having accommodated a recording paper with a size designated by an instruction by an operator, and conveys recording papers P accommodated in each paper feeding cassette toward the aforementioned nip portion N.

In addition, when the image forming apparatus 1 performs duplex printing, after a recording paper P having one surface, on which an image has been formed by the image forming unit 12, is nipped by a discharge roller pair 159, the recording paper P is switched back by the discharge roller pair 159 to be sent to a reverse conveyance path 195, and is conveyed again to an upstream region of a conveyance direction of the recording paper P by a conveying roller 19 with respect to the aforementioned nip portion N and fixing unit 13. In this way, an image is formed on the other surface of the recording paper by the image forming unit 12.

Figure 2:
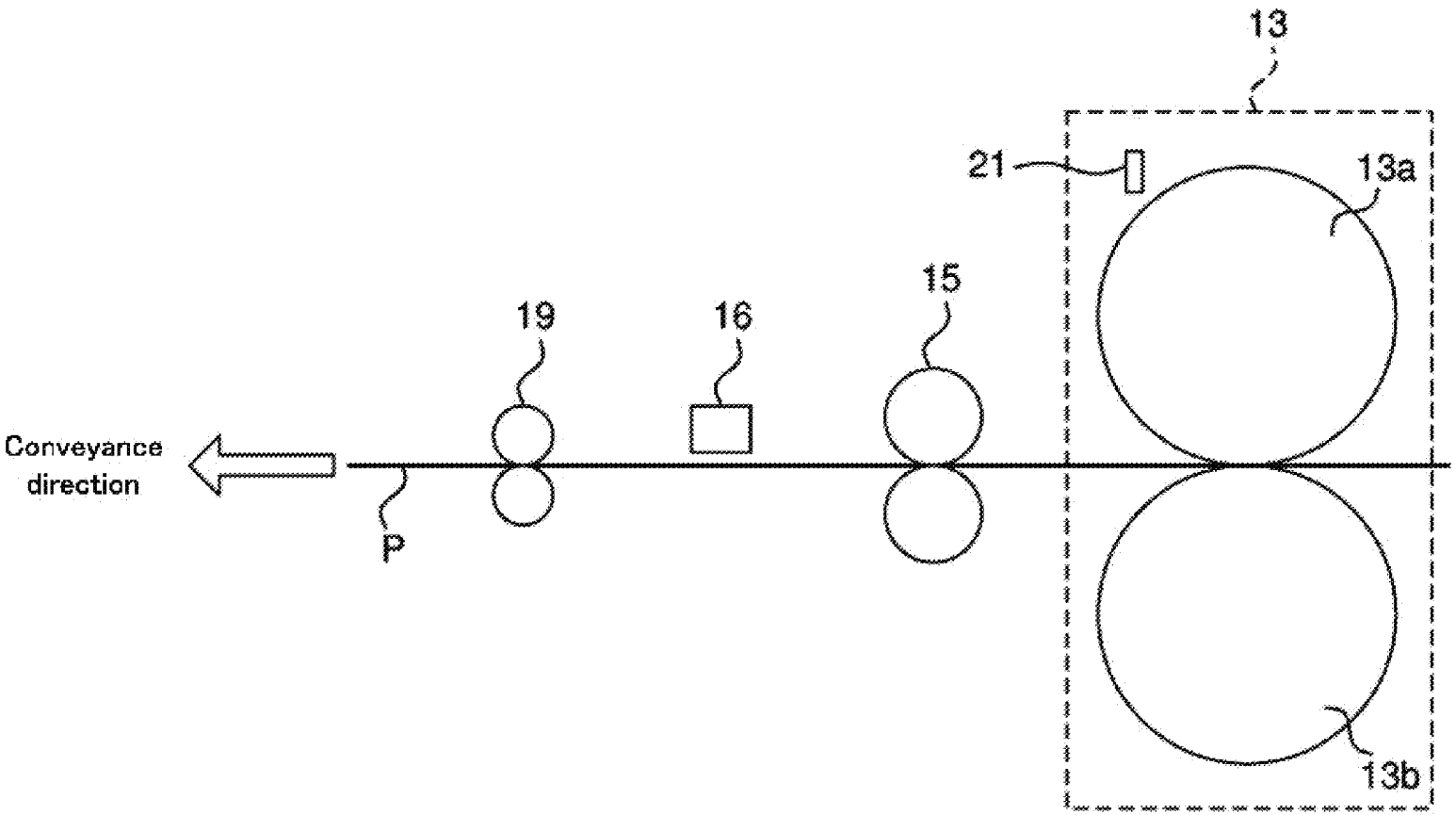
FIG. 2 is a front sectional view illustrating a fixing unit and members arranged at a conveyance downstream side thereof.

Moreover, the following description will be given using FIG. 2. FIG. 2 is a front sectional view illustrating the fixing unit 13 and members arranged at a conveyance downstream side thereof. At the conveyance downstream side of the fixing unit 13, a rubbing roller 15, an image density detection unit 16, and the conveying roller 19 are sequentially arranged.

The fixing unit 13 allows toner constituting the toner image transferred to the recording paper P to be molten so as to be fixed to the recording paper P. The fixing unit 13 includes a heating roller 13*a* with an embedded heater (not illustrated) and a pressing roller 13*b* brought into press contact with the heating roller 13*a*. The heater, for example, can be configured with a halogen heater, or an IH heater provided with an induction heating unit having an exciting coil and a core.

At a position adjacent to the heating roller 13*a*, a thermistor 21 is disposed to detect surface temperature of the heating roller 13*a*. The heating roller 13*a* and the pressing roller 13*b* convey the recording paper P with the transferred toner image so as to be interposed therebetween. The recording paper P is conveyed so as to be interposed between the heating roller 13*a* and the pressing roller 13*b*, so that the toner transferred to the recording paper P is molten and fixed. For example, the control section 100 (FIG. 3) controls the driving of the aforementioned heater on the basis of fixing temperature detected by the thermistor 21, thereby performing the setting of fixing temperature at the time of a fixing operation by the fixing unit 13, which will be described later.

When the recording paper P is inserted into the fixing unit 13 and heat is transmitted to the recording paper P from the heating roller 13*a*, surface temperature of a part of the heating roller 13*a* contacting with the recording paper P falls and surface temperature of a part of the heating roller 13*a* not contacting with the recording paper P is kept high. Accordingly, when the heating roller 13*a* is uniformly heated on the whole, variation occurs in the surface temperature of the heating roller 13*a* in an axial direction. In this regard, preferably, the fixing unit 13 includes a mechanism for compensating for the variation in the surface temperature of the heating roller 13*a* in the axial direction.

The rubbing roller 15 is a roller that rubs a fixing surface of the recording paper P to which the toner image has been fixed by the fixing unit 13. The rubbing roller 15, for example, can be configured with a roller having a winding type cloth. Furthermore, the rubbing roller 15 includes a movement mechanism for moving the rubbing roller 15 between an abutting position and a separation position with respect to the recording paper P so as to abut the recording paper P when fixability evaluation is performed and to be separated from the recording paper P in other cases. Particularly, in the case of performing the fixability evaluation, the rubbing roller 15 holds the recording paper P from up and down according to the movement of the movement mechanism. At this time, the rubbing roller 15 rotates at a peripheral speed equal to a conveying speed of the conveyed recording paper P or a peripheral speed lower than the conveying speed with respect to the conveyed recording paper P, thereby rubbing the fixing surface of the recording paper P. At this time, when a fixing process is performed at fixing temperature lower than appropriate temperature and the fixability of the toner image is poor, toner is peeled from the recording paper P by the rubbing of the rubbing roller 15, resulting in the reduction of image density of the fixing surface.

The image density detection unit 16 detects the image density of the fixing surface of the recording paper P having passed through the rubbing roller 15. The image density detection unit 16, for example, can be configured with an optical sensor such as an ID sensor including a light emitting unit and a light receiving unit. In this case, the light emitting unit irradiates light to the fixing surface of the recording paper P and the light receiving unit detects reflected light of the light. The image density of the fixing surface of the recording paper P is detected in response to the strength of the light received in the light receiving unit.

The conveying roller 19 is a roller pair that conveys the recording paper P toward the image forming unit 12 and the fixing unit 13. The conveying roller 19 conveys the recording paper P rubbed by the rubbing roller 15 to the discharge roller pair 159. The conveying roller 19 and a driving motor (FIG. 3) is an example of a conveying unit.

Figure 3:
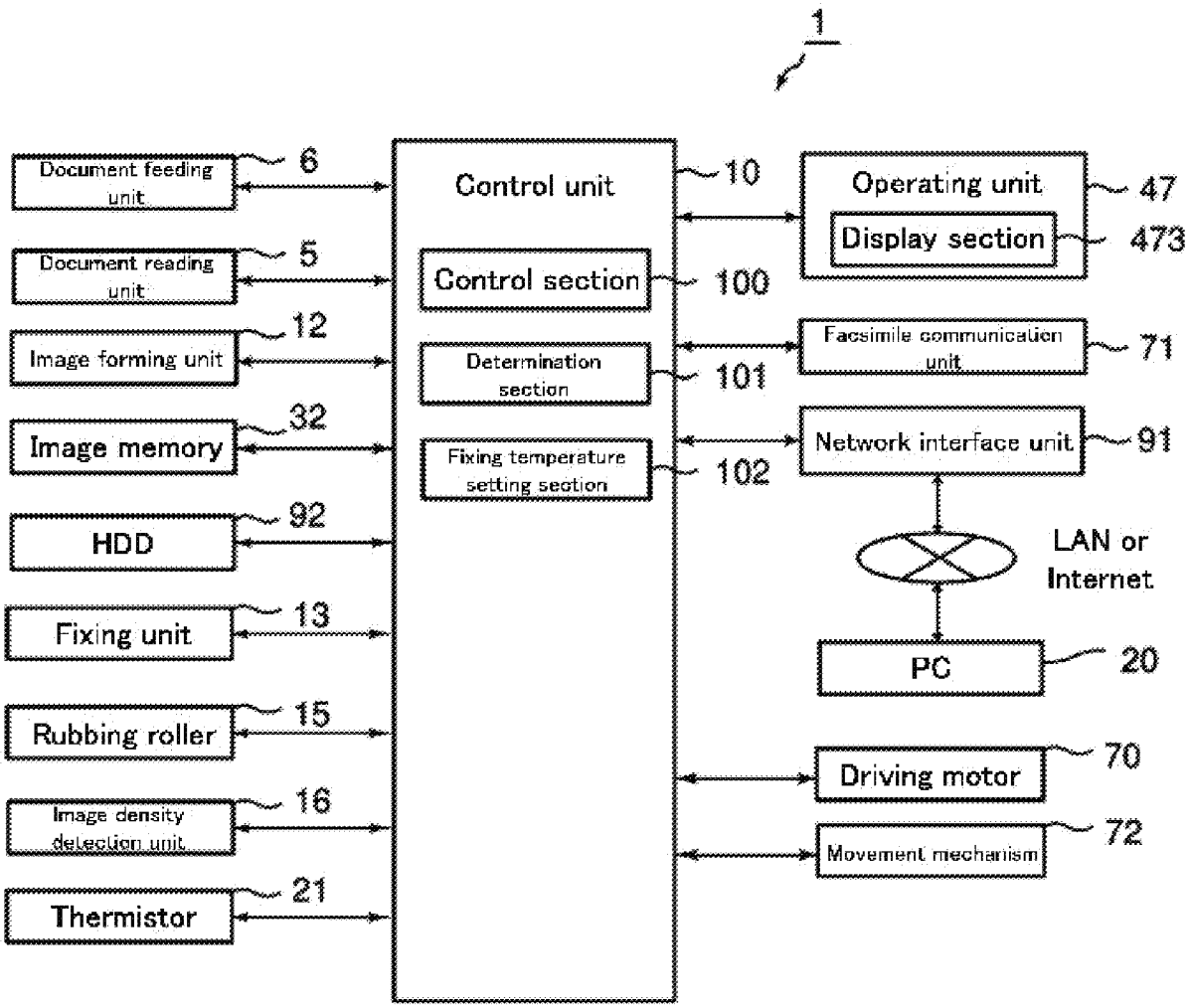
FIG. 3 is a functional block diagram illustrating a main internal configuration of an image forming apparatus.

FIG. 3 is a functional block diagram illustrating a main internal configuration of the image forming apparatus 1. The image forming apparatus 1 includes a control unit 10, the operating unit 47, the document feeding unit 6, the document reading unit 5, an image memory 32, the image forming unit 12, the fixing unit 13, the rubbing roller 15, the image density detection unit 16, the driving motor 70, a facsimile communication unit 71, a network interface unit 91, an HDD 92 and the like.

The document reading unit 5 includes a reading mechanism 163 (FIG. 1) having a light irradiating unit, a CCD sensor and the like under the control of the control unit 10. The document reading unit 5 irradiates a document with the light irradiating unit and receives its reflected light by the CCD sensor, thereby reading an image from the document.

The image memory 32 is an area that temporarily stores data of the document image obtained by the reading of the document reading unit 5, or temporarily preserves data which is a print target of the image forming unit 12.

The facsimile communication unit 71 includes an encoding and decoding unit, a modulation and demodulation unit, and a NCU (Network Control Unit) (not illustrated), and performs transmission of facsimile by using a public telephone line network.

The network interface unit 91 includes a communication module such as a LAN board, and performs transmission/reception of various types of data with a computer 20 and the like in a local area or on the Internet via a LAN and the like connected to the network interface unit 91.

The HDD 92 is a storage device with a large capacity that stores the document image, which has been read by the document reading unit 5, and the like.

The driving motor 70 is a driving source that applies rotational driving force to each rotating member of the image forming unit 12, the conveying roller 19 and the like.

A movement mechanism 72 is a mechanism that allows the rubbing roller 15 to move to the abutting position and the separation position with respect to the recording paper P so as to abut the recording paper P when the fixability evaluation is performed and to be separated from the recording paper P in other cases. The control section 100 controls the movement mechanism 72.

The control unit 10 includes a CPU (Central Processing Unit), a RAM, a ROM, a dedicated hardware circuit and the like, and performs entire operation control of the image forming apparatus 1. The control unit 10 includes the control section 100.

The control section 100 is connected to the operating unit 47, the document feeding unit 6, the document reading unit 5, the image memory 32, the image forming unit 12, the fixing unit 13, the rubbing roller 15, the image density detection unit 16, the driving motor 70, the facsimile communication unit 71, the network interface unit 91, the HDD and the like, and performs control of these elements. Particularly, the control section 100 controls the image forming unit 12 to form a plurality of patch images for fixability evaluation on one piece of recording paper P. Furthermore, the control section 100 variously changes the fixing temperature of the fixing unit 13 for each patch image formed on the recording paper P, thereby fixing the patch image to the recording paper P. Furthermore, the control section 100 controls the movement mechanism 72 so that the rubbing roller 15 rubs the fixing surface of the recording paper P with the fixed patch image.

A determination section 101 determines whether a ratio of image density of a part rubbed by the rubbing roller 15 and image density of a part not-rubbed, detected by the image density detection unit 16 in the aforementioned each patch image fixed by the fixing unit 13, is within a preset reference value (within a preset range of appropriate image density). That is, on the basis of the image density of the fixing surface of the rubbed recording paper P detected by the image density detection unit 16, the determination section 101 performs fixability evaluation at each fixing temperature.

A fixing temperature setting section 102 sets fixing temperature, which has been used in the fixing of the patch image determined to be within the aforementioned preset reference value by the determination section 101, as fixing temperature to be used at the time of normal image formation by the image forming unit 12. The normal image formation indicates image formation which is performed on the basis of data to be printed and not the formation of a corresponding patch image. That is, on the basis of a result of the aforementioned fixability evaluation, the fixing temperature setting section 102 decides fixing temperature optimal in the fixing of the recording paper P by the fixing unit 13.

In the image forming apparatus 1 according to the present embodiment, under the control of the control section 100, the fixing temperature of the fixing unit 13 is variously changed while one piece of recording paper P is passing through the fixing unit 13, so that fixability evaluation is performed by the determination section 101 a plurality of times. Hereinafter, an embodiment of fixability evaluation by the image forming apparatus 1 according to the present embodiment will be described.

First Embodiment

Figure 4:
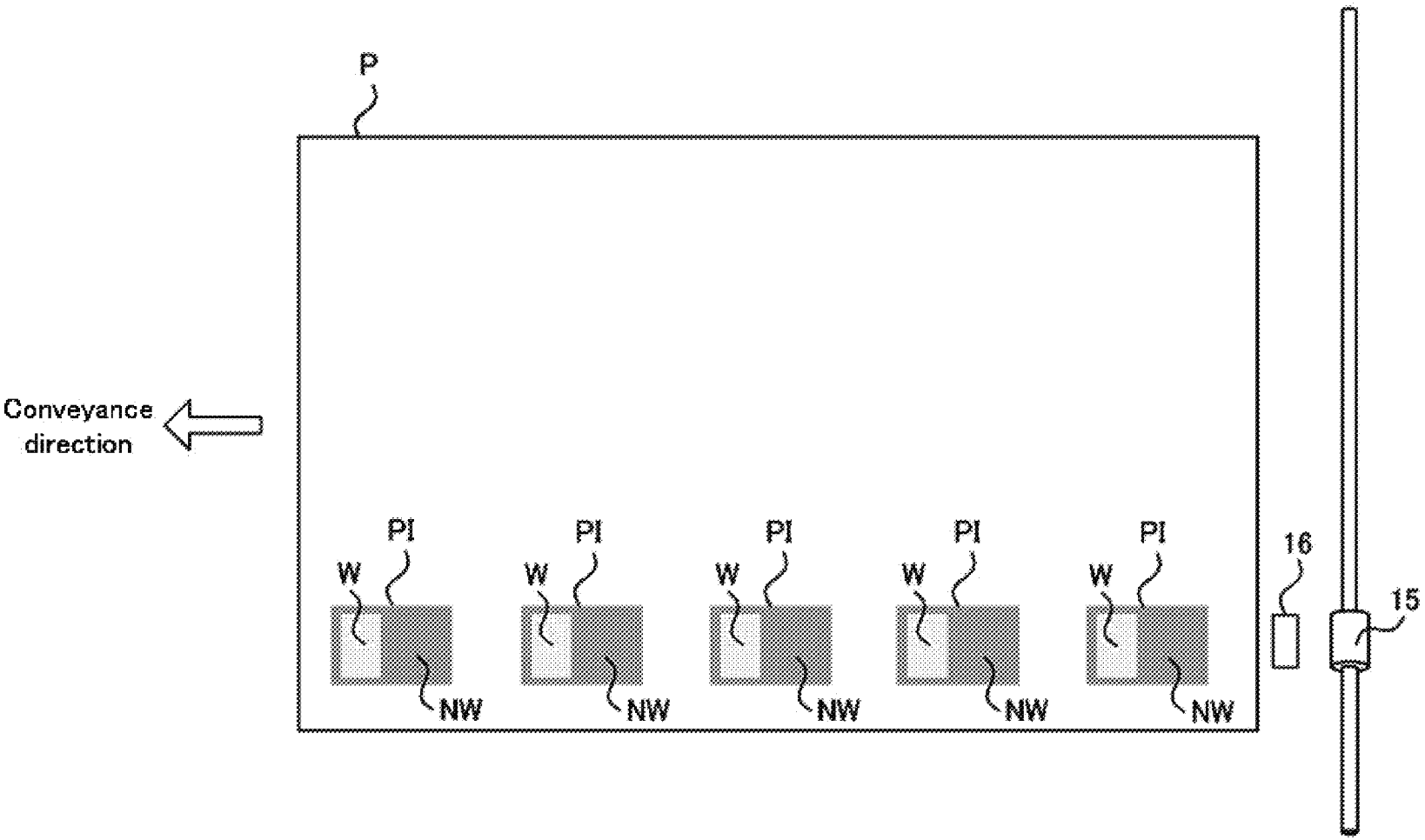
FIG. 4 is a diagram illustrating an example of a patch image for fixing evaluation used in fixability evaluation according to a first embodiment.
Figure 5:
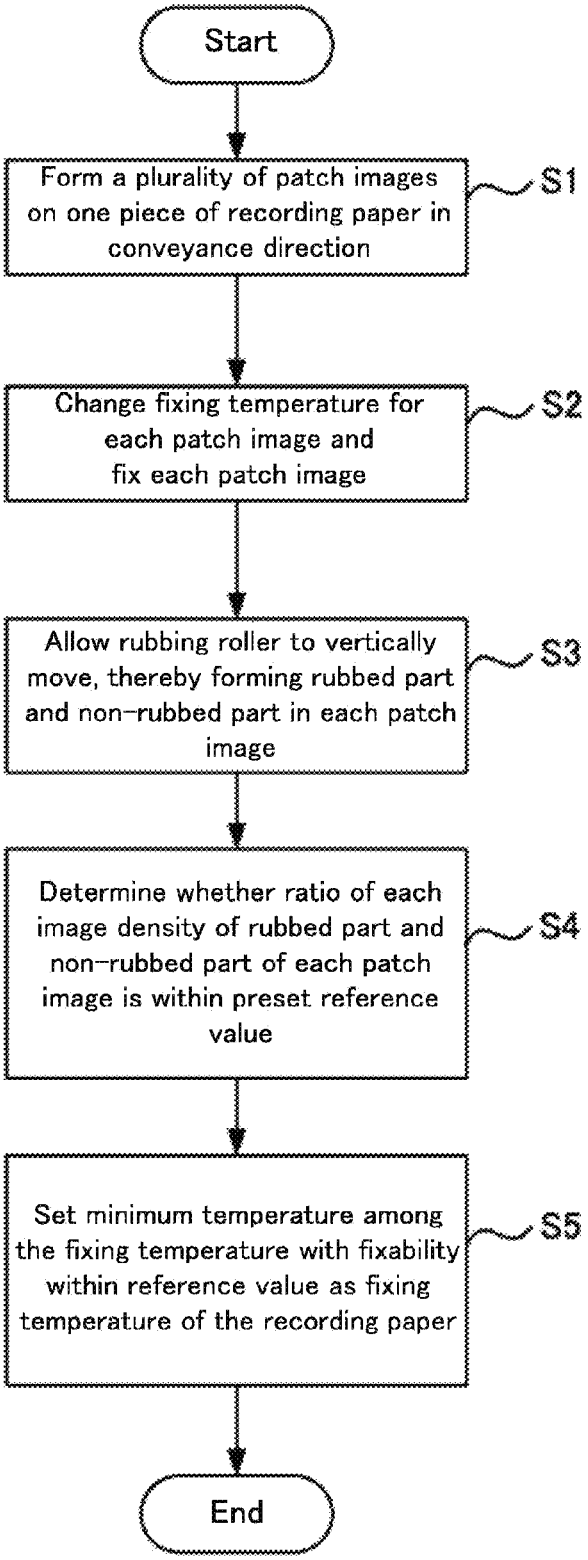
FIG. 5 is a flowchart illustrating the flow of processing at the time of fixability evaluation according to a first embodiment.

FIG. 4 is a diagram illustrating an example of a patch image for fixing evaluation used in fixability evaluation according to a first embodiment. FIG. 5 is a flowchart illustrating the flow of processing at the time of the fixability evaluation according to the first embodiment.

The fixability evaluation, for example, is performed at an arbitrary timing set in the control section 100 before normal image formation is performed by the image forming unit 12, when the recording paper P has been changed, when a toner container has been exchanged, and the like.

In the case of performing the fixability evaluation, firstly, the control section 100 controls the image forming unit 12 so as to form a plurality of patch images PI for the fixability evaluation on one piece of recording paper P conveyed by the conveying roller 19 at a preset interval along a recording paper conveyance direction (S1). The patch image PI is an image with preset color, density, size, and shape (for example, a rectangular gray image having preset density). The formation positions of the patch images PI on the recording paper P in a direction vertical to the conveyance direction are positions facing the rubbing roller 15 and the image density detection unit 16 arranged spaced from the fixing surface of the recording paper P.

When the formation of the patch images PI is completed, the control section 100 changes the fixing temperature of the fixing unit 13 for each patch image PI formed on the recording paper P and fixes the patch images PI to the recording paper P (S2). At this time, the control section 100 stops the conveyance of the recording paper P by the conveying roller 19 whenever one patch image PI is fixed by the fixing unit 13. After changing the fixing temperature of the fixing unit 13, the control section 100 restarts the conveyance of the recording paper P by the conveying roller 19, thereby controlling the fixing unit 13 to fix a subsequent patch image PI. At this time, the heating roller 13*a* and the pressing roller 13*b* wait for the recording paper P in a nipped state until the fixing temperature reaches next target temperature, and when temperature detected by the thermistor 21 reaches the next target temperature, the control section 100 restarts the operations of the heating roller 13*a* and the pressing roller 13*b*, thereby allowing a subsequent read patch image PI to be fixed to the recording paper P.

For example, the control section 100 controls the aforementioned heater provided in the heating roller 13*a* to increase the fixing temperature in S2 step by step from preset minimum fixing temperature to preset maximum fixing temperature for each patch image. For example, the control section 100 increases the fixing temperature step by step by the heater from 140° C. to 170° C. at an interval of 10° C. In this case, fixing temperature of a first patch image PI is allowed to be 140° C., fixing temperature of a second patch image PI is allowed to be 150° C., fixing temperature of a third patch image PI is allowed to be 160° C., and fixing temperature of a fourth patch image PI is allowed to be 170° C., so that the respective patch images PI are fixed.

Furthermore, when the control section 100 increases the fixing temperature step by step by the heater from 150° C. to 170° C. at an interval of 5° C., fixing temperature of a first patch image PI is allowed to be 150° C., fixing temperature of a second patch image PI is allowed to be 155° C., fixing temperature of a third patch image PI is allowed to be 160° C., fixing temperature of a fourth patch image PI is allowed to be 165° C., and fixing temperature of a fifth patch image PI is allowed to be 170° C., so that the respective patch images PI are fixed. Alternatively, the control section 100 may also set fixing temperature as arbitrary temperature for each patch image PI without increasing the fixing temperature step by step. As described above, a method for changing the fixing temperature is not limited thereto, and the fixing temperature in S2 may also be reduced step by step from maximum fixing temperature to minimum fixing temperature for each patch image. However, since an increase in the temperature of the heating roller 13*a* is easily controllable by the use of the heater, but a decrease in the temperature of the heating roller 13*a* requires a time due to natural cooling, it is preferable to employ the method for increasing the fixing temperature step by step.

In addition, when a change width of the fixing temperature in S2 is approximately set from 10° C. to 40° C., since a time required for increasing the temperature of the fixing unit 13 within this temperature range is very small, influence to the recording paper P is not particularly concerned.

At the timing at which the recording paper P with the fixed patch image PI is conveyed and each patch image PI reaches a position facing the rubbing roller 15, the control section 100 drives the aforementioned movement mechanism 72 to allow the rubbing roller 15 to abut and be separated from the recording paper P (move vertically), thereby forming a part (a rubbed part W) rubbed and a part (a non-rubbed part NW) not rubbed in the aforementioned conveyance direction in each patch image PI (S3). For example, as illustrated in FIG. 4, the control section 100 forms the rubbed part W at a downstream side of each patch image PI in the conveyance direction and the non-rubbed part NW at an upstream side of each patch image PI in the conveyance direction. Alternatively, the control section 100 may also form the rubbed part W at the upstream side of each patch image PI in the conveyance direction and the non-rubbed part NW at the downstream side of each patch image PI in the conveyance direction.

When the rubbed part W and the non-rubbed part NW are formed in the patch image PI, the image density detection unit 16 detects each image density of the rubbed part W and the non-rubbed part NW of the patch image PI passing through an opposite position. The determination section 101 acquires the image density of the rubbed part W and the non-rubbed part NW of each patch image PI from the image density detection unit 16, and determines whether a ratio of each image density of the rubbed part W and the non-rubbed part NW for each patch image PI is within a preset reference value (S4). For example, suppose that the determination section 101 respectively sets the image density of the rubbed part W and the image density of the non-rubbed part NW as ID1 and ID2, the determination section 101 calculates fixability R by Equation of fixability R=ID1/ID2, and determines whether the fixability R is within a constant range as the aforementioned reference value, for example, a range of 0.8 to 0.95. That is, the determination section 101 determines a patch image PI with the fixability R within the range among the plurality of patch images PI formed on the recording paper P.

Then, the fixing temperature setting section 102 sets minimum temperature among the fixing temperatures with the fixability R within the range used for fixing the patch images PI as fixing temperature to be used at the time of the normal image formation by the image forming unit 12 (S5).

Then, the control section 100 causes the fixing unit 13 to perform fixing for the recording paper P at the set fixing temperature at the time of normal image formation to be subsequently performed.

Second Embodiment

Figure 6:
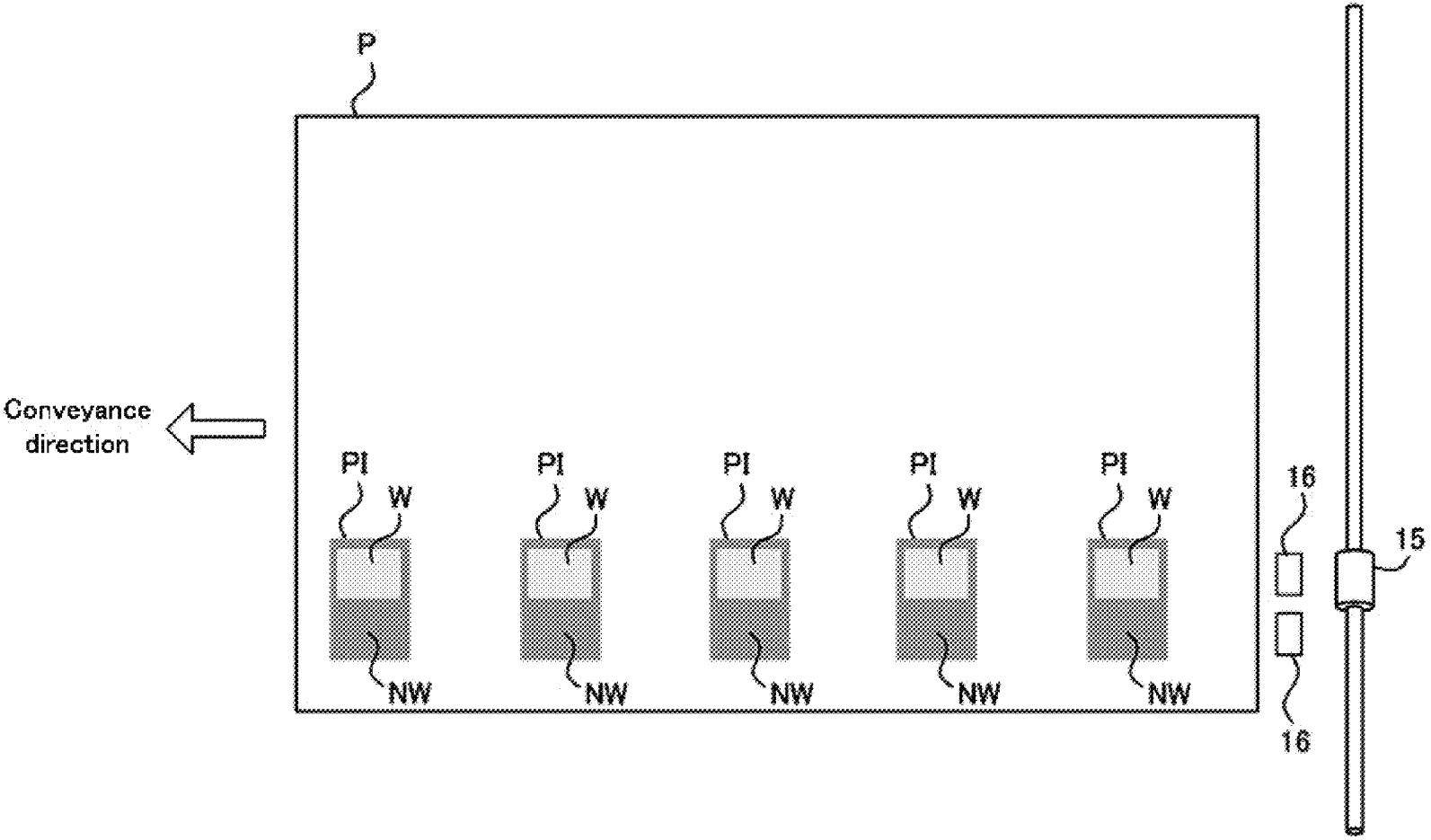
FIG. 6 is a diagram illustrating an example of a patch image for fixing evaluation used in fixability evaluation according to a second embodiment.
Figure 7:
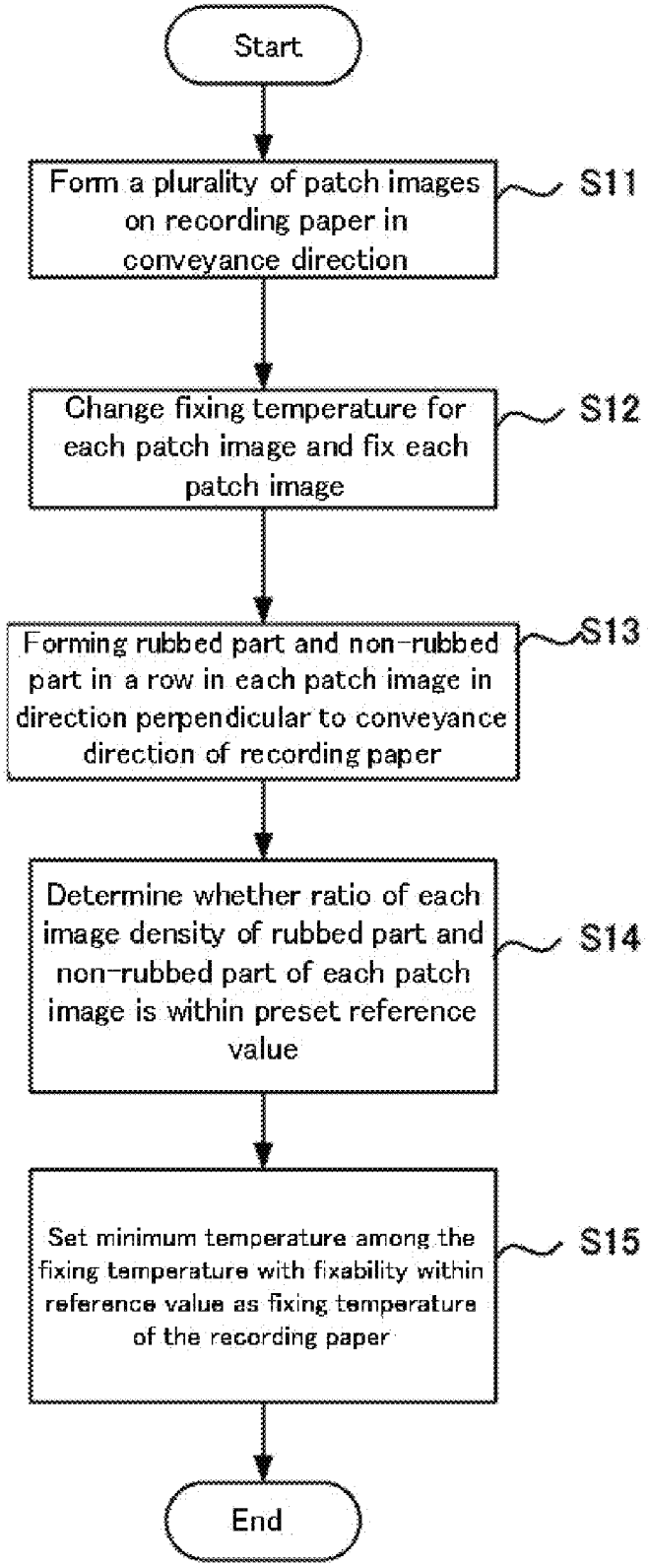
FIG. 7 is a flowchart illustrating the flow of processing at the time of fixability evaluation according to a second embodiment.

FIG. 6 is a diagram illustrating an example of a patch image for fixing evaluation used in fixability evaluation according to a second embodiment. FIG. 7 is a flowchart illustrating the flow of processing at the time of the fixability evaluation according to the second embodiment. The second embodiment is different from the first embodiment in terms of the formation method of the rubbed part W and the non-rubbed part NW in the patch image PI and the arrangement of the image density detection unit 16, but the others are similar to the first embodiment. Hereinafter, in the following description of the second embodiment, points similar to the first embodiment will not be described and only differences will be described.

In the case of performing the fixability evaluation, the control section 100 controls the image forming unit 12 to form a plurality of patch images PI for the fixability evaluation on one piece of recording paper P conveyed by the conveying roller 19 at a preset interval in a recording paper conveyance direction (S11).

When the formation of the patch images PI is completed, whenever one patch image is fixed by the fixing unit, the control section 100 changes the fixing temperature of the fixing unit 13 for each patch image PI formed on the recording paper P and fixes each patch image PI by the fixing unit 13 to the recording paper P (S12).

Herein, formation positions of each patch image PI in a direction perpendicular to the conveyance direction of the recording paper P are positions facing the rubbing roller 15 and two image density detection units 16 arranged in a row in the perpendicular direction. In addition, a width of the patch image PI is sufficiently wider than that of the rubbing roller 15. For example, the rubbing roller 15 has a width corresponding to about a half of the width of the formed patch image PI in the aforementioned perpendicular direction. That is, the rubbing roller 15 rubs an area corresponding to about a half of the patch image PI in the perpendicular direction, and does not rub other areas.

When the control section 100 causes the conveying roller 19 to convey the recording paper P with each fixed patch image PI, the rubbing roller 15 rubs an area corresponding to about a half of the patch image PI in the aforementioned perpendicular direction. In this way, in each patch image PI, a part (a rubbed part W) rubbed and a part (a non-rubbed part NW) not rubbed by the rubbing roller 15 are formed in a row in the direction perpendicular to the recording paper conveyance direction (S13).

When the rubbed part W and the non-rubbed part NW are formed in the patch image PI, the aforementioned two image density detection units 16 detect each image density of the rubbed part W and the non-rubbed part NW of the patch image PI. The control section 100 acquires each image density of the rubbed part W and the non-rubbed part NW of the patch image PI from each image density detection unit 16, and determines whether a ratio of each image density of the rubbed part W and the non-rubbed part NW for each patch image PI is within a preset reference value similarly to the first embodiment (S14).

Then, similarly to the first embodiment, the fixing temperature setting section 102 sets minimum temperature among the fixing temperatures with the fixability R within the range for fixing the patch images PI as fixing temperature to be used at the time of normal image formation by the image forming unit 12 (S15). The control section 100 sets the temperature decided in step S15 as the fixing temperature of the fixing unit 13 from printing of a next recording paper.

When the first embodiment and the second embodiment are compared with each other, the first embodiment has an advantage in cost because only one image density detection unit 16 is required and thus the number of parts is reduced.

On the other hand, the second embodiment has a disadvantage in cost as compared with the first embodiment because two image density detection units 16 are required, but a time required for density detection is shortened because density of the rubbed part W and the non-rubbed part NW arranged in the direction perpendicular to the aforementioned conveyance direction can be simultaneously detected by the two image density detection units 16. Furthermore, in the second embodiment, since the rubbed part W and the non-rubbed part NW of each patch image PI can be arranged in a row in the direction perpendicular to the aforementioned conveyance direction, the width of each patch image PI in the aforementioned conveyance direction can be reduced as compared with the first embodiment, so that it is possible to ensure an interval between the patch images PI wider. Therefore, the second embodiment has an advantage that more patch images PI are formed on one piece of recording paper P as compared with the first embodiment, so that it is possible to perform fixability evaluation a greater number of times. Furthermore, in the second embodiment, since a time interval after a patch image PI is conveyed to arrangement positions of the image density detection units 16 until a next patch image PI is conveyed becomes long as compared with the first embodiment, it is possible to reliably change fixing temperature of the patch images PI.

As described above, according to the first and second embodiments, since it is possible to perform fixability evaluation for a plurality of patch images PI by using one piece of recording paper P, the amount of recording papers P to be used in the fixability evaluation can be minimized, and it is possible to set in a short time appropriate fixing temperature for each type of a recording medium to be used in image formation as the recording paper P, that is, minimum fixing temperature required for the fixing of an image. In this way, fixing conditions can be optimized for each of various recoding medium to be used in image formation in the image forming apparatus 1, and minimum fixing temperature required for each recording medium can be set while improving and maintaining image quality, so that it is possible to reduce power consumption.

So far, although the present embodiments have been described, the technology of the present disclosure is not limited to the configurations of the aforementioned embodiments and various modifications can be made. Furthermore, the technology of the present disclosure can be applied to a copy machine, a facsimile machine, a printer and the like in addition to the aforementioned multifunctional peripheral.

Furthermore, the configurations and processes described in the aforementioned embodiments with reference to FIG. 1 to FIG. 7 are merely an embodiment of the technology of the present disclosure, and it is not intended to limit the technology of the present disclosure to the aforementioned configurations and processes.

What is claimed is:

1. An image forming apparatus comprising:

a conveying unit configured to convey a recording paper;

an image forming unit configured to form a toner image on the recording paper conveyed by the conveying unit;

a fixing unit configured to fix the toner image, which has been formed on the recording paper by the image forming unit, to the recording paper by thermal compression;

a control section configured to cause the image forming unit to form a plurality of patch images on one piece of recording paper at a preset interval in a conveyance direction of the recording paper, and to change a fixing temperature of the fixing unit for each of the formed patch images for fixing the patch images to the recording paper;

a rubbing roller configured to rub a part of each patch image fixed by the fixing unit;

an image density detection unit configured to detect image density of each patch image on the recording paper having passed through the rubbing roller;

a determination section configured to determine whether a ratio of image density of a part rubbed by the rubbing roller and image density of a part not-rubbed, detected by the image density detection unit in each fixed patch image, is within a preset reference value; and a fixing temperature setting section configured to set a minimum temperature among the fixing temperatures, which have been used in fixing the patch images and have the ratios of image density determined to be within the preset reference value by the determination section, as a fixing temperature to be used at a time of normal image formation by the image forming unit.

2. The image forming apparatus of claim 1, further comprising:

a movement mechanism configured to allow the rubbing roller to abut and to be separated from each patch image on a fixing surface of the recording paper during conveyance of the recording paper by the conveying unit.

3. The image forming apparatus of claim 1, wherein two image density detection units are provided at positions facing the patch images in a direction perpendicular to the conveyance direction, and the rubbing roller rubs a position of each patch image facing one of the image density detection units and does not rub a position of each patch image facing a remaining one of the image density detection units.

4. The image forming apparatus of claim 1, wherein the control section stops conveyance of the recording paper by the conveying unit whenever one patch image is fixed by the fixing unit, changes the fixing temperature of the fixing unit, and restarts the conveyance of the recording paper by the conveying unit for fixing a subsequent read patch image by the fixing unit.

5. The image forming apparatus of claim 1, wherein the control section increases the fixing temperature of the fixing unit step by step for each patch image arranged in the conveyance direction.

* * * * *